US005699764A

United States Patent [19]

Allen et al.

[11] Patent Number: 5,699,764

[45] Date of Patent: Dec. 23, 1997

[54] BYPASS TIMER CIRCUIT

[75] Inventors: Spencer W. Allen; John K. Apostolides, both of Pittsburgh, Pa.

[73] Assignee: RPM Industries, Inc., Washington, Pa.

[21] Appl. No.: 583,977

[22] Filed: Jan. 11, 1996

[51] Int. Cl.[6] ..... F02N 11/08

[52] U.S. Cl. ..... 123/196.5; 123/179.5

[58] Field of Search ..... 327/142, 182, 327/284, 290; 340/527, 547, 309.15, 309.6; 123/196, 179.3, 179.5

[56] References Cited

U.S. PATENT DOCUMENTS

| | | | |
|---|---|---|---|
| 3,254,242 | 5/1966 | Sillers, Jr. | 327/261 |
| 3,693,030 | 9/1972 | Walters | 307/273 |
| 4,107,553 | 8/1978 | Carter | 307/293 |
| 4,168,693 | 9/1979 | Harrison | 123/196 S |
| 4,185,605 | 1/1980 | Latgent, Sr. | 123/179 B |
| 4,249,118 | 2/1981 | Roof | 388/816 |
| 4,502,431 | 3/1985 | Lulich | 123/179 A |
| 4,893,598 | 1/1990 | Stasiuk | 123/196 S |
| 5,014,820 | 5/1991 | Evans | 184/6.3 |
| 5,165,107 | 11/1992 | Hand et al. | 340/309.6 |
| 5,195,476 | 3/1993 | Schwarz | 123/179.5 |
| 5,442,336 | 8/1995 | Murphy et al. | 340/628 |

*Primary Examiner*—Henry Yuen
*Assistant Examiner*—Hieu T. Vo
*Attorney, Agent, or Firm*—Titus & McConomy

[57] ABSTRACT

The present invention relates to an electrical bypass timer circuit for temporarily disabling a delay feature which would otherwise prevent activation of a system until the delay has lapsed. During the period that the bypass timer circuit is active, the delay feature is overridden, allowing the system to be activated. After the bypass timer circuit has deactivated, the delay feature becomes operative, preventing activation of the system until the delay has lapsed. The bypass timer circuit can be used with any system where a delay is desired prior to system activation, to eliminate that delay when permitted by system operating characteristics. The bypass timer circuit can take the form of a software-driven computer processor, a solid-state digital logic control network, or a network of discrete electrical components incorporating a timing function. One preferred embodiment of the invention is designed for an internal combustion engine pre-lubrication system, and uses a network of discrete resistors and capacitors that electrically discharges within a set time period determined by the circuit configuration and the physical characteristics of the resistors and capacitors incorporated into the network. This embodiment of the bypass timer circuit is electrically connected to the system and to the delay circuitry to cause an override of the delay circuitry during the period that the resistor-capacitor network is undergoing discharge. During the discharge period, this override of the delay circuitry permits the system starting circuitry to receive an enabling signal which activates the system. After the discharge has ended, the delay circuitry takes effect to prevent the receipt of the enabling signal by the system starting circuitry until the delay has lapsed.

18 Claims, 3 Drawing Sheets

BYPASS TIMER CIRCUIT

FIELD OF THE INVENTION

The present invention relates to a bypass timer circuit. A preferred embodiment of the bypass timer circuit is designed for use with an internal combustion engine pre-lubrication system.

BACKGROUND OF THE INVENTION

Several inventions have been developed to eliminate the friction problem that exists when an internal combustion engine is started up, which causes deterioration and premature wear of engine components due to inadequate initial lubrication of moving parts. These inventions supply lubrication to the moving parts before the engine is started, through the use of pre-lubrication pumping systems that generate normal operating oil pressure before combustion.

For example, U.S. Pat. No. 4,502,431 discloses a conventional pre-lubrication system that pumps oil into an internal combustion engine before it is started. This system operates in a sequence that involves: (1) mining a key to activate the pre-lubrication system; (2) lubricating the engine by means of an oil pump driven by the engine starter motor; (3) delaying combustion until normal operating oil pressure is achieved; and (4) starting the engine when normal operating oil pressure has been reached.

In this and other conventional combustion engine pre-lubrication systems, engine start up is delayed while oil is pumped in to generate adequate oil pressure. Before the present invention, there was no way to bypass the pre-lubrication system if the engine was restarted when oil pressure remained sufficiently high to permit a start without pre-lubrication. Many engines that include a pre-lubrication system are incorporated in large pieces of industrial equipment. The loss of control power experienced during the pre-lubrication period has created a need for an immediate restart capability to be provided with the conventional pre-lubrication systems used in this equipment. The present invention provides this immediate restart capability, allowing the equipment operator to avoid a loss of control power caused by an unnecessary pre-lubrication delay, a feature which is particularly important during an emergency condition.

It is an object of the present invention to provide an electrical bypass timer circuit for temporarily disabling a delay feature which would otherwise prevent activation of a system until the delay has lapsed.

It is a further object of this invention to provide an electrical bypass timer circuit, using a software-driven computer processor, for temporarily disabling a delay feature which would otherwise prevent activation of a system until the delay has lapsed.

It is a further object of this invention to provide an electrical bypass timer circuit, using a solid-state digital logic control network, for temporarily disabling a delay feature which would otherwise prevent activation of a system until the delay has lapsed.

It is a further object of this invention to provide an electrical bypass timer circuit, using a network of discrete electrical components incorporating a timing function, for temporarily disabling a delay feature which would otherwise prevent activation of a system until the delay has lapsed.

It is a further object of this invention to provide an electrical bypass timer circuit designed for an internal combustion engine pre-lubrication system.

SUMMARY OF THE INVENTION

The present invention relates to an electrical bypass timer circuit for temporarily disabling a delay feature which would otherwise prevent activation of a system until the delay has lapsed. During the period that the bypass timer circuit is active, the delay feature is overridden, allowing the system to be activated. After the bypass timer circuit has deactivated, the delay feature becomes operative, preventing activation of the system until the delay has lapsed. The bypass timer circuit can be used with any system where a delay is desired prior to system activation, to eliminate that delay when permitted by system operating characteristics. The bypass timer circuit can take the form of a software-driven computer processor, a solid-state digital logic control network, or a network of discrete electrical components incorporating a timing function. One preferred embodiment of the invention is designed for an internal combustion engine pre-lubrication system, and uses a network of discrete resistors and capacitors that electrically discharges within a set time period determined by the circuit configuration and the physical characteristics of the resistors and capacitors incorporated into the network. This embodiment of the bypass timer circuit is electrically connected to the system and to the delay circuitry to cause an override of the delay circuitry during the period that the resistor-capacitor network is undergoing discharge. During the discharge period, this override of the delay circuitry permits the system starting circuitry to receive an enabling signal which activates the system. After the discharge has ended, the delay circuitry takes effect to prevent the receipt of the enabling signal by the system starting circuitry until the delay has lapsed.

BRIEF DESCRIPTION OF THE DRAWINGS

FIG. (1) is a side view of an internal combustion engine using a pre-lubrication system.

FIG. (2) is a side view of the internal combustion engine starter motor.

Figure 1:
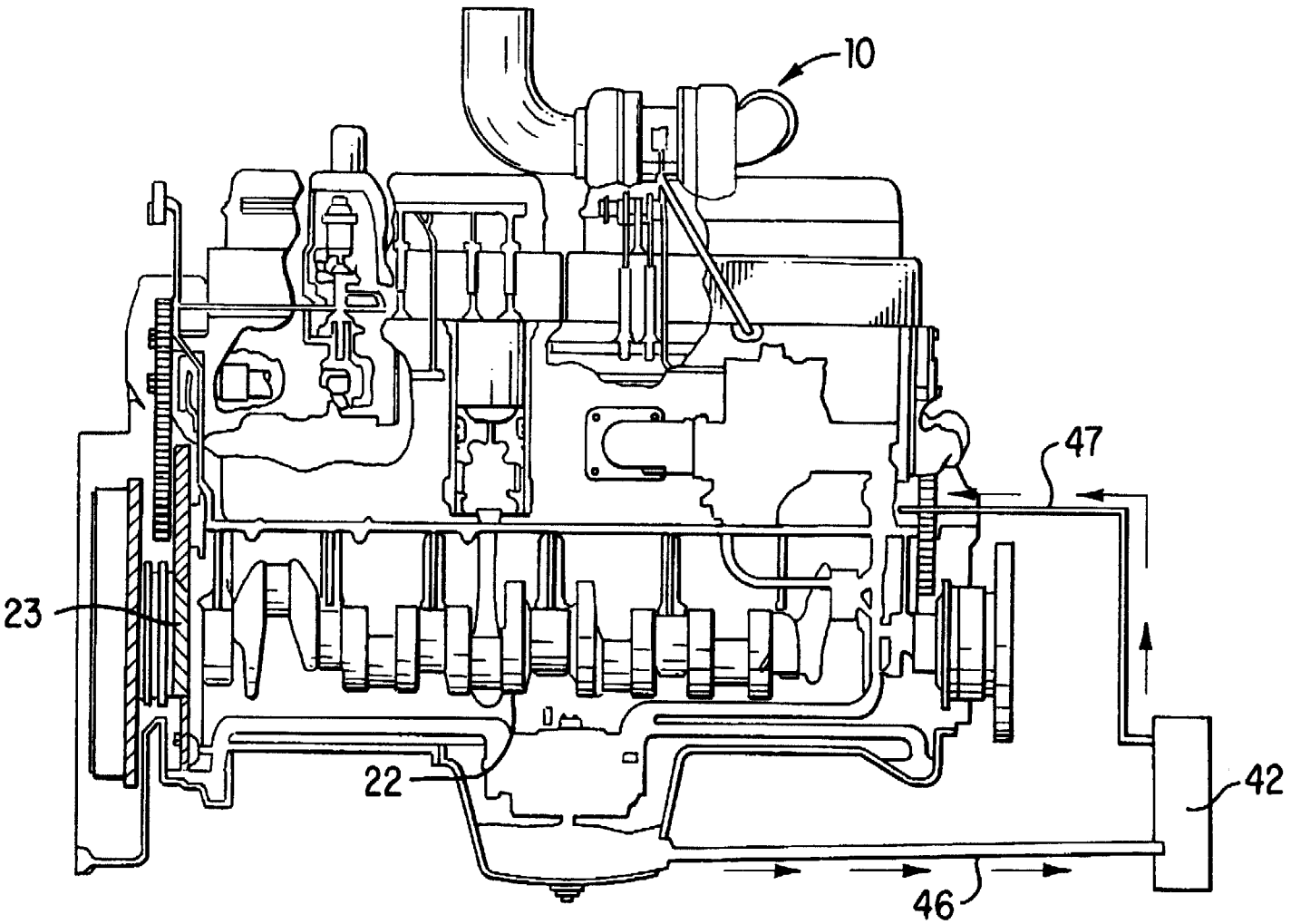
Figure 2:
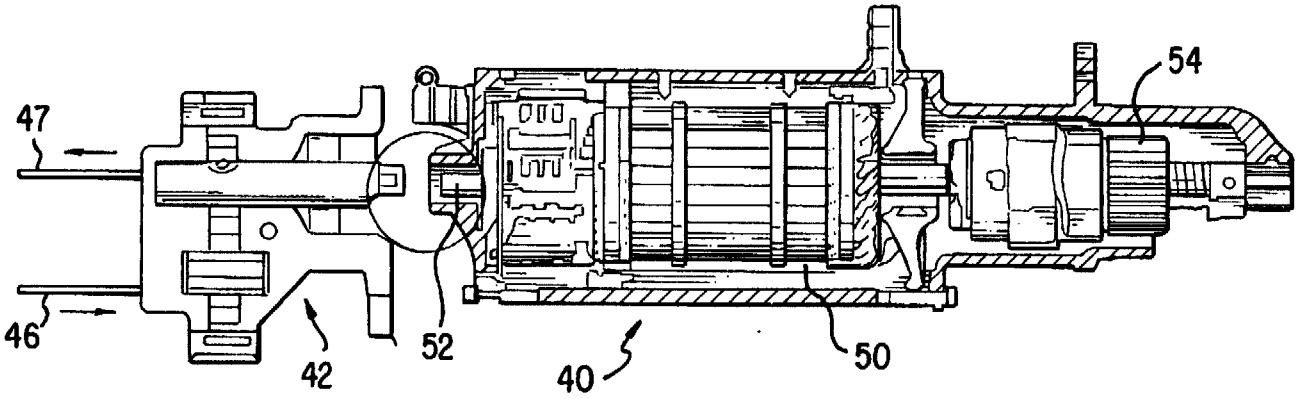
Figure 3:
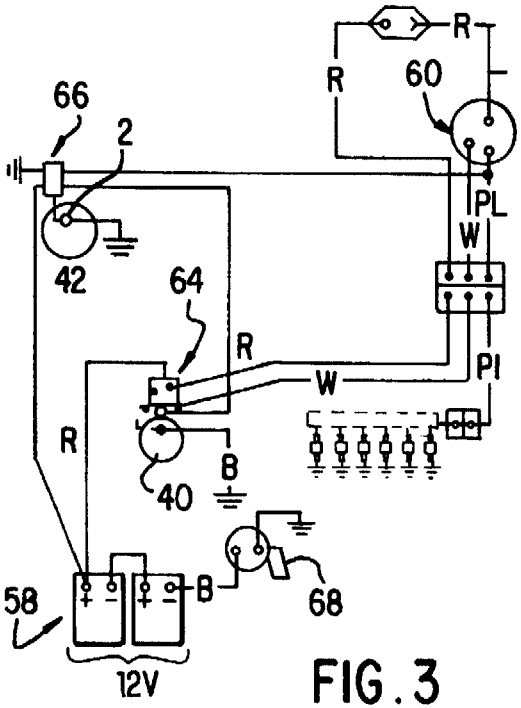
Figure 4:
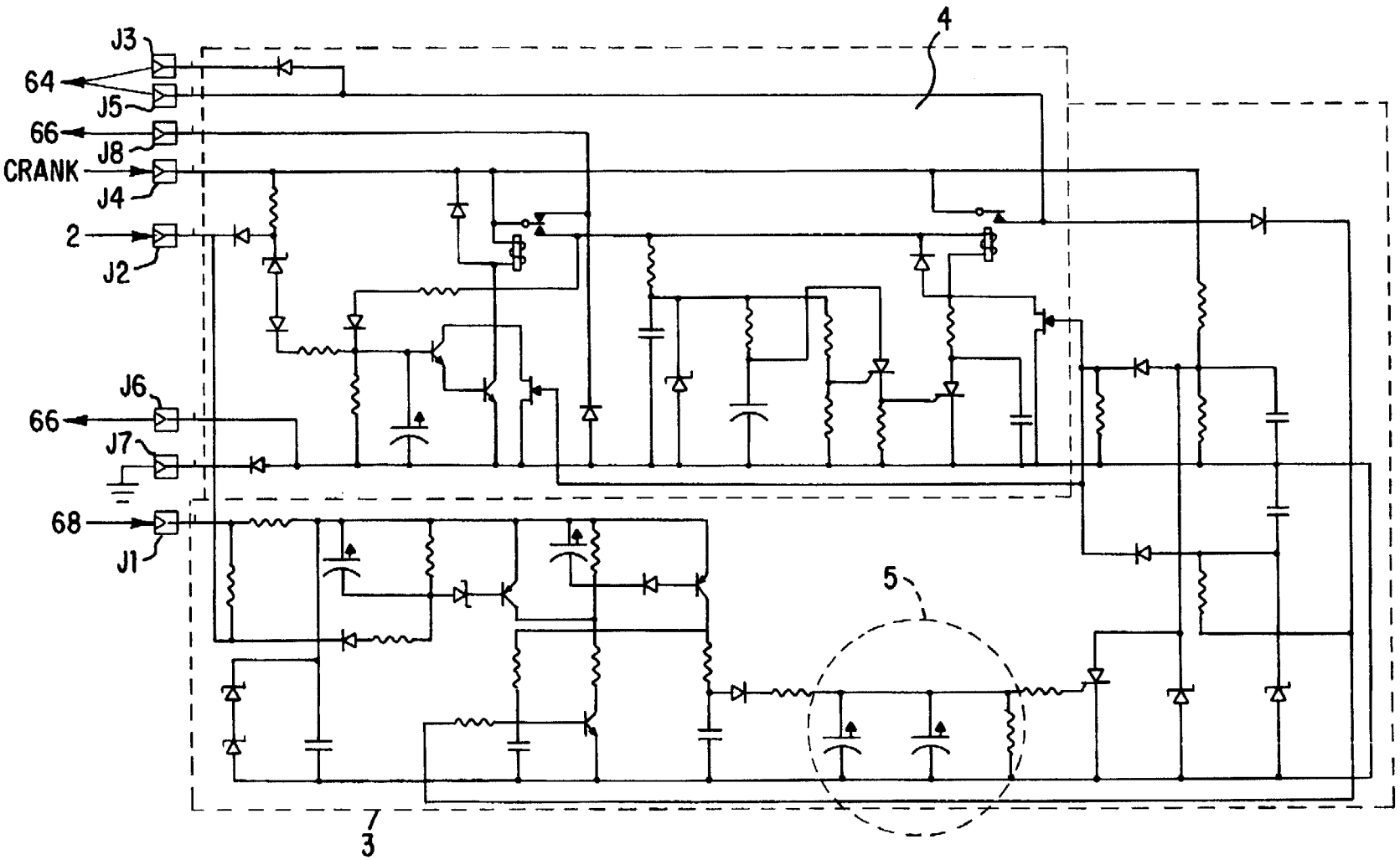

FIG. (3) is a schematic diagram of the internal combustion engine starting circuit.

FIG. (4) is a schematic diagram of the control logic of the internal combustion engine starting circuit, with a bypass timer circuit incorporated into the pre-lubrication control circuit.

DETAILED DESCRIPTION OF THE PREFERRED EMBODIMENT

A preferred embodiment of the invention is used with an internal combustion engine, having a pre-lubrication system as described in U.S. Pat. No. 4,502,431 to ensure adequate engine lubrication prior to start up. For purposes of illustration, the combustion engine and pre-lubrication system described in U.S. Pat. No. 4,502,431 is shown in FIGS. (1) through (3).

The internal combustion engine 10 shown in FIG. (1) has an electrical starter assembly 40 as shown in FIG. (2), which is comprised of an electrical direct current (DC) starter motor 50 that rotates an armature shaft 52 extending through both sides of the starter motor 50 housing. The starter motor armature shaft 52 is connected on one end to a starter gear 54 that engages the flywheel 23 that rotates the engine crankshaft 22 when the engine is started. The opposite end of the starter motor armature shaft 52 drives a pre-lubrication oil pump 42, which provides lubrication to the engine 10 through an oil inlet line 46 and an oil outlet line 47 prior to start up.

As shown schematically in FIG. (3), the starter assembly 40 is energized by electrical starting circuitry that includes batteries 58, a starter switch 60, a first solenoid 64, a second solenoid 66, and an ignition switch 68. The starter switch 60 has at least an OFF position, a RUN position and a CRANK position corresponding to the OFF position, RUN position and START position of the engine starter switch 68, respectively. In the OFF position the electrical system is inactive. In the CRANK position, electricity flows from the batteries 58 to the first solenoid 64, activating the starter motor 50 to engage the starter gear 54, initiating combustion.

In the pre-lubrication system disclosed in U.S. Pat. No. 4,502,431, a separate HEAT AND PUMP position (not currently used for the pre-lubrication system applicable to this disclosure) also causes energization of the second solenoid 66, which energizes the starter motor 50 without engaging the starter gear 54, causing rotation of the pre-lubrication oil pump 42 to deliver oil to the engine 10 prior to start up. The pre-lubrication oil pump 42 remains energized during the entire preheat period to achieve normal operating oil pressure prior to combustion.

In the pre-lubrication system described in U.S. Pat. No. 4,502,431, an operator initiates the normal operating mode pre-lubrication sequence by turning the vehicle ignition switch 68 to the START position. This activates the CRANK position of the engine starter switch 60. This CRANK signal is sent to the pre-lubrication control logic 4 shown in FIG. (4), which activates the pre-lubrication oil pump 42 by energizing the second solenoid 66 through engine oil pressure switch 2, shown schematically in FIG. (3). During the pumping phase, the pre-lubrication control logic 4 blocks receipt of the CRANK signal by the first solenoid 64, preventing the initiation of combustion. When normal operating oil pressure is achieved, the initially closed engine oil pressure switch 2 goes to the open position, causing de-energization of the pre-lubrication oil pump 42 and the simultaneous activation of a 3.2 second time delay circuit formed within the pre-lubrication control logic 4, which continues to block receipt of the CRANK signal by the first solenoid 64 to prevent the initiation of combustion for the duration of the delay period. When the 3.2 second delay period has ended, the CRANK signal is directed by the pre-lubrication control logic 4 to the first solenoid 64 to initiate combustion as described above.

The normal operation mode of the internal combustion engine pre-lubrication system described in U.S. Pat. No. 4,502,431 thus results in approximately a 3.2 second delay between the achievement of normal operating oil pressure and the initiation of combustion. The preferred embodiment of the invention provides a bypass timer circuit which permits both the pumping cycle and the 3.2 second pre-lubrication delay to be overridden, allowing a start sequence that does not require pre-lubrication if restart is attempted during a preset time period after the running of the engine and/or the completion of a previous pre-lubrication cycle. Thus, the improvement provides a means for bypassing the normal operation mode of the pre-lubrication system described in U.S. Pat. No. 4,502,431 and its corresponding delay, if the engine has been started recently and the oil pressure remains sufficiently high to eliminate the need for pre-lubrication.

As shown in FIG. (4), the invention adds a bypass timer circuit 3 to the pre-lubrication control logic 4 to bypass the normal operation mode of the pre-lubrication pumping system. Upon initial start up of the engine, the normal operation mode pre-lubrication pump/delay/start sequence takes place, as described above. During initial start up, the 3.2 second pre-lubrication delay is invoked by the pre-lubrication control logic 4, without activation of the bypass timer circuit 3. When the 3.2 second pre-lubrication delay has passed, the bypass timer circuit 3 detects the CRANK signal, and the "discharge clock" of the bypass timer circuit 3 is armed.

In the embodiment shown in FIG. (4), the "discharge clock" of the bypass timer circuit 3 consists of a resistor-capacitor network 5 that is charged when the CRANK signal is sensed by the bypass timer circuit 3. The circuit configuration and physical characteristics of the components incorporated into the resistor-capacitor network 5 will generate a constant preset time delay during subsequent discharge of the resistor-capacitor network 5 (the "bypass time constant"). In the embodiment shown in FIG. (4), this "bypass time constant" is set for a window of approximately 80–120 seconds, although it could be set for any time period up to 200 seconds. The resistor-capacitor network 5 is charged within 50 milliseconds.

The resistor-capacitor network 5 sustains its charge until (1) the ignition key is turned to the OFF position (i.e. the ignition switch 68 is not in either the RUN or START position, preventing a run signal from being sensed by the engine starting circuitry), or (2) until the oil pressure switch 2 returns to its CLOSED (or grounded) position (i.e., a "false OFF" situation where an engine stalls but the ignition switch is left in the RUN position). If either of these two conditions occur, the "discharge clock" of the bypass timer circuit 3 will activate, and discharge of the resistor-capacitor network 5 will begin. This discharge will occur for the period determined by the "bypass time constant", during which the bypass timer circuit 3 disables first the pump cycle and then the subsequent 3.2 second pre-lubrication delay.

If a START signal is then sensed by the engine starting circuit within the period that the "discharge clock" is active, the bypass timer circuit 3 will permit the CRANK signal to be sent directly to the first solenoid 64, bypassing both the pumping phase and the 3.2 second delay sequence of the normal operation mode to permit immediate restart of the engine without pre-lubrication. If restart is not attempted within the period that the "discharge clock" is active, both the pump cycle and the 3.2 second pre-lubrication time delay will be reimposed by the pre-lubrication control logic 4 to provide for pre-lubrication pursuant to the normal operation mode pump/delay/start sequence.

To sense the time remaining on the "discharge clock", the bypass timer circuit 3 uses a voltage comparitor circuit. If the voltage in the resistor-capacitor network 5 is at least fifty percent (50%) of its initial charge voltage, the pumping cycle and the 3.2 second pre-lubrication delay will be overridden and an immediate restart will occur. If the voltage in the resistor-capacitor network 5 is less than fifty percent (50%) of the initial charge voltage, the pumping cycle and the 3.2 second pre-lubrication delay will not be overridden, and the normal operating mode pre-lubrication start will occur. This ratiometric voltage comparitor logic is independent of the system voltage.

FIG. (4) shows the control logic of the engine starting circuit, with the bypass timer circuit 3 incorporated into the pre-lubrication control logic 4. Pin 14 is the input for the CRANK signal. Pins J8 and J6 are the positive and negative output connections, respectively, to the second solenoid 66 that activates the pre-lubrication oil pump 42 without energizing the starter motor 50. Pin J5 and J3 are the output connections to the first solenoid 64 that are energized when the CRANK signal is sent to the starter motor 50 to initiate combustion. Pin J2 is the input for the oil pressure switch 2 and pin J7 is the ground. Pin J1 is an input from the ignition switch 68 when the key is in the RUN or ON position. In the current preferred embodiment, the bypass timer circuit 3 uses a five (5) pin connector to interface with the pre-lubrication control logic 4 of the engine starting circuit, although a connector having an appropriate number of pins for the signals may be used.

The bypass timer circuit design uses components already existing in the pre-lubrication control logic utilized with U.S. Pat. No. 4,502,431, which are passive when the engine is off. The same configuration could be used for applications other than the internal combustion engine pre-lubrication circuit. Although a resistor-capacitor discharge network is used to generate the bypass time delay in the embodiment shown in the specification, the bypass timer circuit can use software-driven computer control, solid-state digital logic control, or discrete components to achieve the bypass function performed by the circuit.

Although the invention has been described in detail above for the purpose of illustration, it is to be understood that such detail is solely for that purpose and that variations can be made therein by those of ordinary skill in the art without departing from the spirit and scope of the invention as defined by the following claims including all equivalents thereof.

What is claimed is:

1. An electrical circuit for controlling the lubrication of a combustion engine prior to activation of said engine, comprising:

A. a delay circuit electrically connected to a starting mechanism of said engine and to a means for lubricating said engine, wherein said delay circuit prevents activation of said engine until a delay has lapsed; and B. a timing circuit electrically connected to said delay circuit and having means for automatically bypassing said delay circuit such that said timing circuit permits the activation of said engine while said timing circuit is activated.

2. The electrical circuit of claim 1, wherein said timing circuit is electrically connected to said delay circuit and to said engine such that said timing circuit overrides said delay circuit while said timing circuit is activated to permit said activation of said engine.

3. The electrical circuit of claim 2, wherein said override is eliminated when said timing circuit is deactivated such that said delay circuit prevents said activation of said engine until said delay has lapsed.

4. The electrical circuit of claim 1, 2 or 3, wherein said delay circuit is comprised of a first network of interconnected electrical components such that said delay circuit is activated for a first time period determined by the configuration of said first network and by the physical characteristics of said electrical components.

5. The electrical circuit of claim 4, wherein said timing circuit is comprised of a second network of interconnected electrical components such that said timing circuit is activated for a second time period determined by the configuration of said second network and by the physical characteristics of said electrical components.

6. The electrical circuit of claim 5, wherein said networks are comprised of:

A. a plurality of resistors; and

B. a plurality of capacitors electrically connected to said resistors.

7. The electrical circuit of claim 5, wherein said networks are comprised of solid-state digital logic components.

8. The electrical circuit of claim 5, wherein said networks are comprised of computer processors.

9. The electrical circuit of claim 8, wherein said computer processors are controlled by programmable computer software.

10. The electrical circuit of claim 1, wherein said delay circuit prevents combustion in said engine until said delay has lapsed, and wherein said timing circuit permits combustion in said engine while said timing circuit is activated.

11. In combination, an engine system and an electrical circuit for controlling the lubrication of said engine prior to combustion of said engine, wherein said engine system is comprised of:

A. an internal combustion engine; and

B. a means for providing lubrication to said engine prior to combustion, comprising:

(i) an oil pump; and (ii) an oil pressure switch that opens to deactivate said oil pump when said engine reaches positive operating oil pressure, and wherein said electrical circuit is comprised of:

C. a delay circuit electrically connected to the starting mechanism of said engine and to said engine lubrication means wherein said delay circuit prevents activation of said engine until a delay has lapsed; and D. a timing circuit electrically connected to said delay circuit and having means for automatically bypassing said delay circuit such that said timing circuit permits the activation of said engine while said timing circuit is activated.

12. The electrical circuit of claim 11, wherein said timing circuit is activated upon the deactivation of said engine.

13. The electrical circuit of claim 11, wherein said timing circuit is activated upon the closing of said oil pressure switch.

14. The electrical circuit of claim 11, wherein:

A. said delay circuit is comprised of a first network of interconnected electrical components such that said delay circuit is activated for a first time period determined by the configuration of said first network and by the physical characteristics of said electrical components; and B. said timing circuit is comprised of a second network of interconnected electrical components such that said timing circuit is activated for a second time period determined by the configuration of said second network and by the physical characteristics of said electrical components.

15. The electrical circuit of claim 14, wherein said engine is reactivated without prior activation of said lubricating means during said second time period.

16. The electrical circuit of claim 14, wherein said first time period is at least 3.2 seconds.

17. The electrical circuit of claim 14, wherein said second time period is substantially within the range of 80 to 120 seconds.

18. The electrical circuit of claim 14, wherein said second time period has a limit of 200 seconds.

* * * * *